US005862562A

United States Patent [19]

Erken

[11] Patent Number: 5,862,562

[45] Date of Patent: Jan. 26, 1999

[54] WIPING DEVICES

[76] Inventor: Jacob Wilhelmus Erken, 17 Burns Crescent, Chiswick, New South Wales 2046, Australia

[21] Appl. No.: 929,675

[22] Filed: Sep. 15, 1997

Related U.S. Application Data

[63] Continuation of Ser. No. 358,009, Dec. 16, 1994, abandoned, which is a continuation of PCT/AU93/00287 Jun. 16, 1993.

[30] Foreign Application Priority Data

Jun. 16, 1992 [AU] Australia ..... PL2982

[51] Int. Cl.[6] ..... A47L 1/06; A47L 13/11; A47L 13/12

[52] U.S. Cl. ..... 15/117; 15/121; 15/144.1; 15/220.1; 15/245

[58] Field of Search ..... 15/117, 121, 144.1, 15/220.1, 245

[56] References Cited

U.S. PATENT DOCUMENTS

| | | | |
|---|---|---|---|
| 503,888 | 8/1893 | Wiebush | 15/121 |
| 727,035 | 5/1903 | Van Loan | 15/144.1 X |
| 1,503,449 | 7/1924 | Bowen | 15/117 |
| 2,446,401 | 8/1948 | Ziskind | 15/121 |
| 2,887,712 | 5/1959 | Vosbikian et al. | 15/121 |
| 2,943,339 | 7/1960 | Vosbikian et al. | 15/144.1 |
| 3,079,623 | 3/1963 | Congdon | 15/121 |
| 3,089,173 | 5/1963 | Hunt | 15/245 |
| 3,108,304 | 10/1963 | Roy | 15/144.1 |
| 3,110,052 | 11/1963 | Whitman | 15/117 |
| 3,892,005 | 7/1975 | Berns | 15/245 |
| 4,236,270 | 12/1980 | Mavis | 15/245 |
| 4,597,204 | 7/1986 | Heiden | 15/144.1 X |
| 4,697,296 | 10/1987 | Smahlik | 15/245 |
| 4,991,246 | 2/1991 | DeCicco | 7/158 |

FOREIGN PATENT DOCUMENTS

| | | | |
|---|---|---|---|
| 276297 | 2/1966 | Australia | 15/144.1 |
| 2229510 | 12/1974 | France | 15/144.1 |
| 2510150 | 5/1976 | Germany | 15/245 |
| 149652 | 12/1931 | Switzerland | 15/144.1 |
| 247968 | 1/1948 | Switzerland | 15/144.1 |
| 287826 | 4/1953 | Switzerland | 15/144.1 |
| WO 88/02615 | 4/1988 | WIPO . | |

*Primary Examiner*—Mark Spisich
*Attorney, Agent, or Firm*—Richard C. Litman

[57] ABSTRACT

A squeegee, liquid applicator or similar device having a handle pivotally attached to a head whereby the head, containing a squeegee blade and/or wiping component, is pivotal relative to the handle in a plane inclined toward the top of the handle when the device is in use whereby motion of the head is readily controllable by rotation or twisting of the handle as the handle follows an "S" shaped path of motion.

23 Claims, 4 Drawing Sheets

WIPING DEVICES

CROSS REFERENCE TO RELATED APPLICATION

This application is a continuation of application Ser. No. 08/358,009 filed on Dec. 16, 1994, abandoned, which is a continuation application based on International Application No. PCT/AU93/00287 filed Jun. 16, 1993.

TECHNICAL FIELD

This invention relates to devices for use in wiping, painting, cleaning, or similar purposes, of substantially flat surfaces such as floors, walls and windows. It has particular advantages in relation to squeegees and devices comprising the combination of a squeegee and a scrubbing or washing device such as a sponge or brush but it is not limited to such devices. The general applicability of devices comprising the present invention will be readily apparent to a skilled addressee.

BACKGROUND

In order to efficiently clean a large surface area, such as a window or floor, it is advantageous to be able to clean in an "S" type side to side sweeping action. This is of a particular advantage when removing water from the surface by using a squeegee as it allows a large surface area to be covered quickly but without leaving behind any water and corresponding streaks. In an effort to obtain this sort of motion, there are known cleaning devices, including squeegees, which have a hinge within a handle so that the angle between the squeegee blade holder and handle can be set at a number of different angles. In some cases these pivots are designed to be used loose, such that the head holding the squeegee blade is free to pivot relative to the handle. However, in those known devices, especially when used with a long handle, there is little or no control of the orientation of the squeegee head which tends to revolve freely making the device practically useless.

In the field of paint application by rollers, brushes, sponges and similar surface contacting devices there are difficulties in obtaining an even finish in a minimum time. The problems of paint application are especially apparent in finishing internal corners with rollers and the need to resort to brushes complete that task.

DISCLOSURE OF INVENTION

In the present invention there is provided a squeegee, cleaning pad, brush, mop, paint applicator or similar article to be used on a substantially planar surface, said device having a handle pivotally connected to a head holding a cleaning, liquid applying, rubbing or scraping component, said pivot being located and orientated so as to allow ready control of orientation of the head of the article during use.

Accordingly, in one broad form, the present invention provides a squeegee, liquid applicator or like device for use on a substantially planar surface, having a head adapted to hold a squeegee blade, pad, brush or the like, a handle extending from a point substantially central of the head, the handle having a longitudinal axis, and a single pivotal connection between the handle and the head, characterised in that the pivotal connection is about an axis which forms with the longitudinal axis of the handle an angle of other than 90 degrees.

Preferably, the head holds a squeegee blade and the pivotal axis of the pivotal connection is substantially at right angles to the longitudinal plane of the squeegee blade.

In another embodiment, the handle is adapted to receive a handle extension attachable to the handle in a torque transmitting arrangement. (In the specification and claims, the term "handle" means a handle or a handle attachment which can receive a handle extension.)

In a further embodiment, a squeegee blade is attached to the head which also includes a cleaning or wiping component positioned so that the component and the sqeegee blade can operate simultaneously on the one flat surface, the squeegee blade trailing the cleaning component during normal use.

In a particular preferred embodiment a device of the present invention comprises a squeegee blade and brush or wiping pad as described in the further embodiment but where the squeegee blade is reversible (about the pivot) or retractable relative to the plane of the brush or pad so that the brush or pad can be used without an associated squeegee action.

A device of the present invention, in operation, and with the handle extending at a substantially constant angle relative to the plane of the surface, function so that any change in orientation of the squeegee will result in, or depend upon, a rotation or twisting of the handle. Thus, by preventing the handle from twisting, the squeegee can be led in a side to side sweep at the end of which it can be swung around 180° in order to commence a second sweep parallel to, but in the opposite direction to, the previous sweep, by allowing or effecting a substantial twist in the handle but while maintaining the handle at a substantially constant angle to the plane of the surface.

BRIEF DESCRIPTION OF DRAWINGS

By way of example only, an embodiment of the invention in the form of a squeegee device will now be described with reference to the accompanying drawings, in which.

BEST MODE

Figure 1:
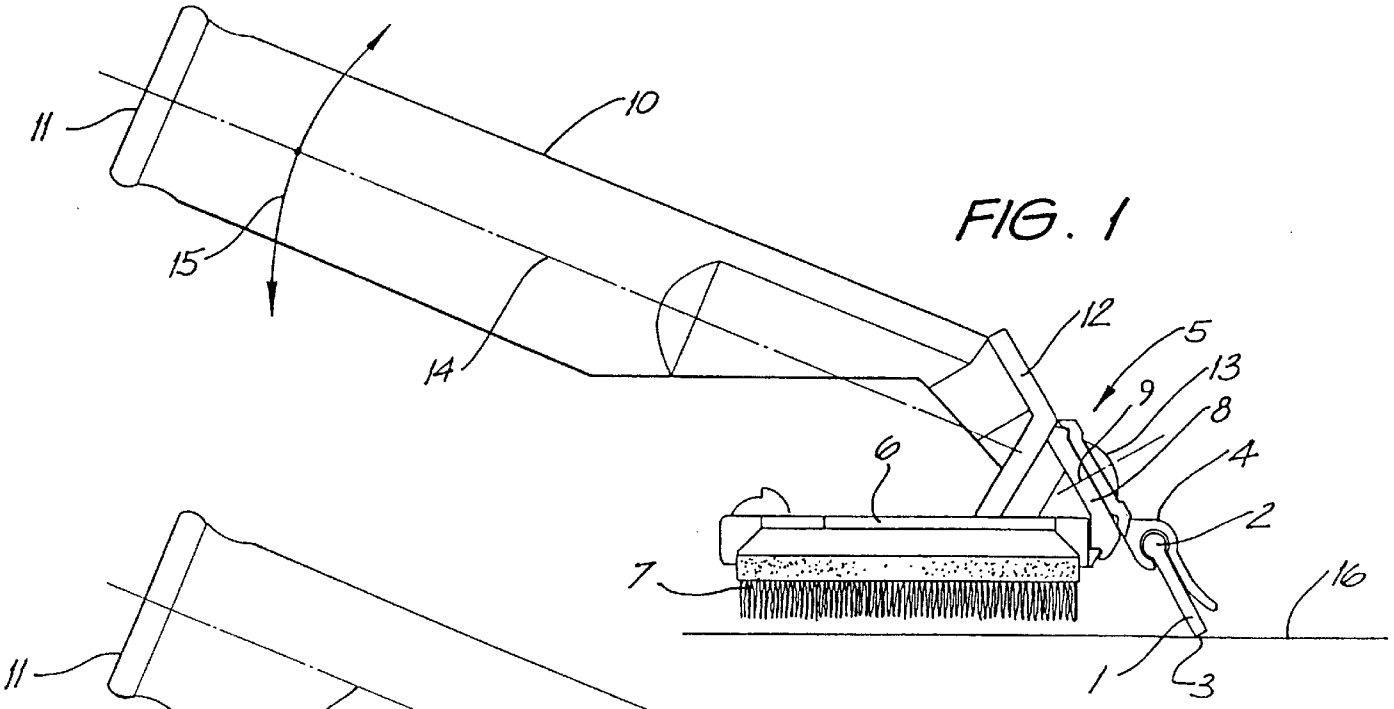
FIG. 1 is a side view of an embodiment of the invention.

A squeegee blade 1 includes an enlarged end 2 and contacts surface 16 at edge 3 when at rest. The enlarged end 2 can be fitted into, and retained in, a complementary channel 4 which is an integral part of head 5.

Attachable to an underside of a portion of the brush holder body 6 is a cleaning element or component 7 which is preferably constructed in a similar way to a carpet material in that it comprises a large number of soft filaments extending out perpendicularly from a base material.

A flange 8 extends generally upwardly from a top portion of the body 6 proximate the channel 4 and includes a through hole 9. The through hole 9 is substantially at right angles to the edge 3.

A handle 10 is provided in order to control the movement of the squeegee device during use, or to accept a handle extension inserted telescopically into opening 11 of the handle 10.

One end of the handle 10 includes a nose piece 12 and a bolt 13 passes through the handle 10 to pivotally attach handle 10 to the body 6 via the flange 8. In this embodiment the bolt 13 is at an angle of 52° relative to the longitudinal axis 14 of the handle 10 which angle is desirably substantially greater than 0° but substantially less than 90°. Because of the angle of the bolt 13 (pivot axis) relative to the longitudinal axis 14 or the handle 10, a change in any one of the orientation of the contact line 3 with the plane of the surface 6 being cleaned, the angle of the longitudinal axis 14 relative to the plane of the surface 16 being cleaned, and the angular orientation or yaw and roll motion 15 of the handle 10 will likely be accompanied by a change in at least one other of those three parameters. Thus, even with a handle extension fitted to handle 10, side to side "S" like sweeping actions can be made and controlled so that the squeegee 1 always remains generally at right angles to the direction of its movement across surface 16 being swept. The motion of the squeegee blade 1 relative to handle 10 can be likened to that of a castoring wheel in allowing sweeping arc like movements of handle 10 while squeegee blade 1 remains in wiping contact with surface 16.

The contact between handle 10 and flange 8 when handle 10 is pivoted to an extreme limit relative to flange 8 about bolt 13 enables handle 10 to impart a yawing moment to blade 1. In this way pivoting of handle 10 causes body 6 and blade 1 to yaw in relation to the longitudinal axis of handle 10.

Figure 10:
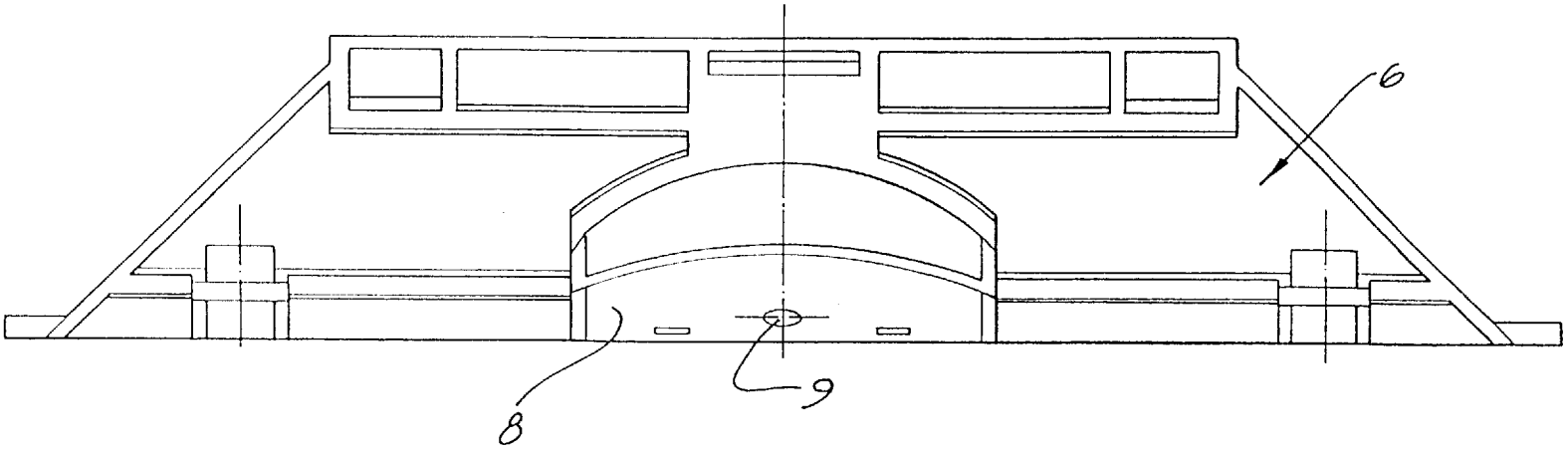
FIG. 10 is a plan view of the body of the device of FIG. 1.

From FIG. 10 it can.be seen that the plan view of body 6 of the device is of a general deltoid or trapezium shape with two parallel sides and two oppositely inclined ends. The inclined ends being inwardly inclined towards the axis of handle 10 when in its central position to facilitate use of t body 6 by enabling the body 6 to be more easily worked into the corner of a window or surface to be swept.

Figure 2:
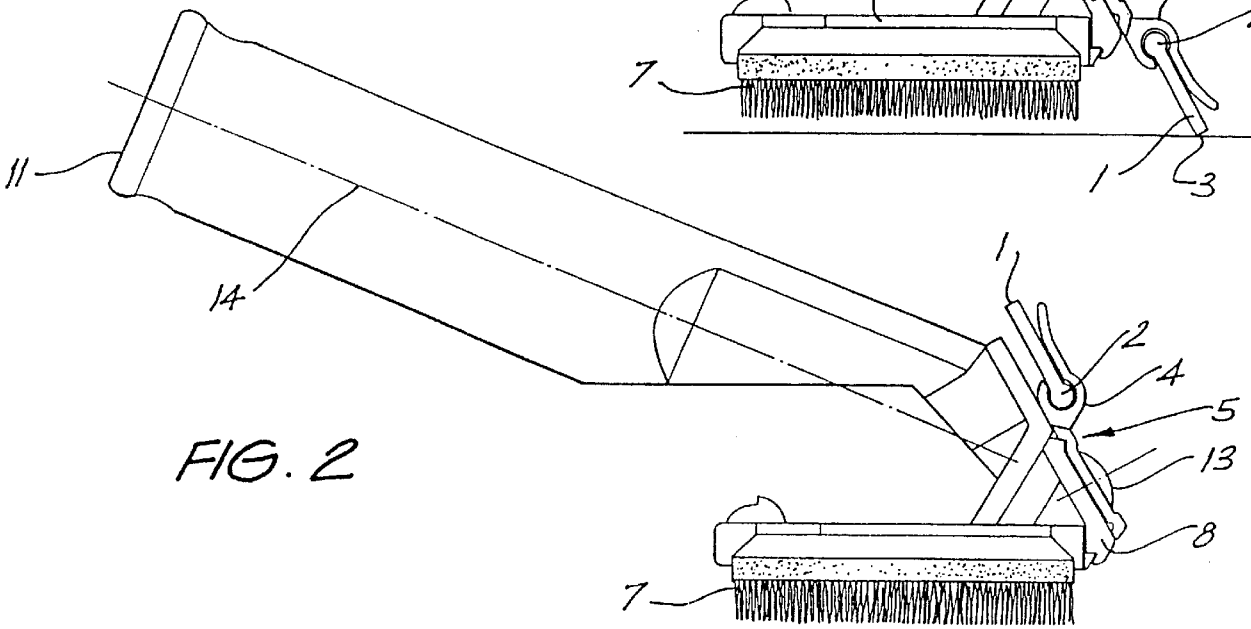
FIG. 2 is the same view as FIG. 1 with the squeegee holder and.blade reversed.
Figure 3:
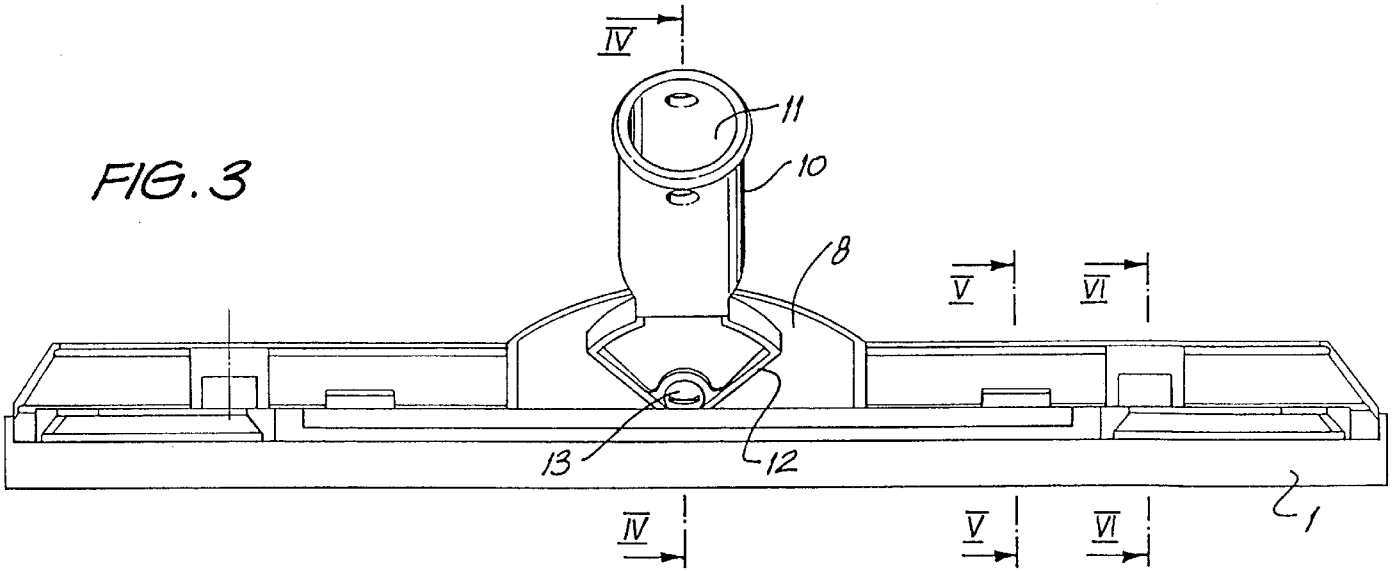
FIG. 3 is a rear view of the device of FIG. 1 with the cleaning component omitted.
Figure 5:
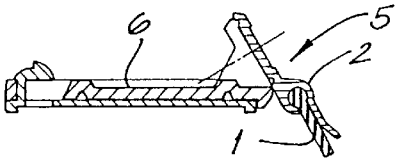
FIG. 5 is the section view V—V of FIG. 3.
Figure 6B:
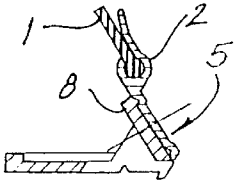
FIG. 6*b* is the section viewer VI—VI of FIG. 3 with the squeegee blade reversed.
Figure 6A:
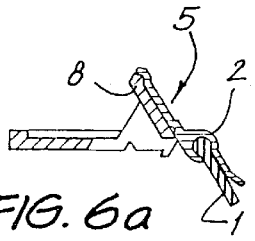
FIG. 6*a* is the section view VI—VI of FIG. 3.
Figure 4:
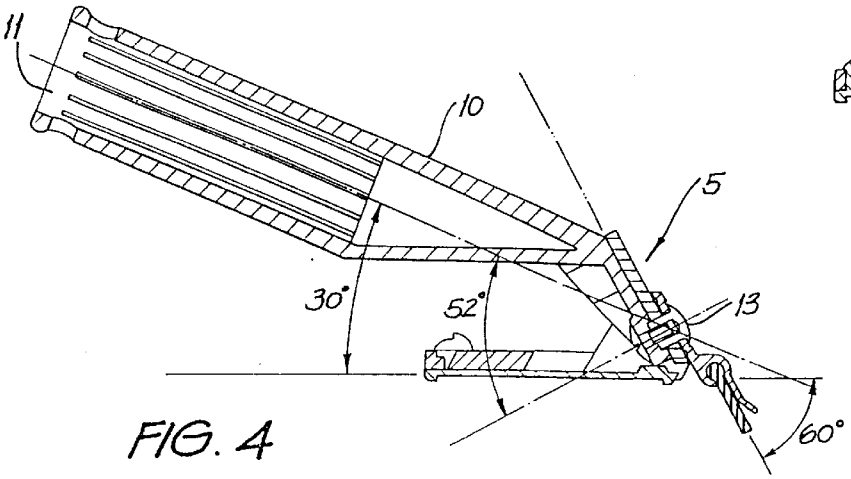
FIG. 4 is the section view IV—IV of FIG. 3.
Figure 9:
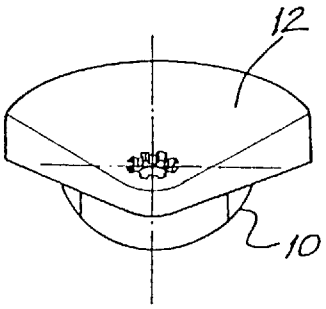
FIG. 9 is a front elevation of the handle of FIGS. 7 and 8.
Figure 7:
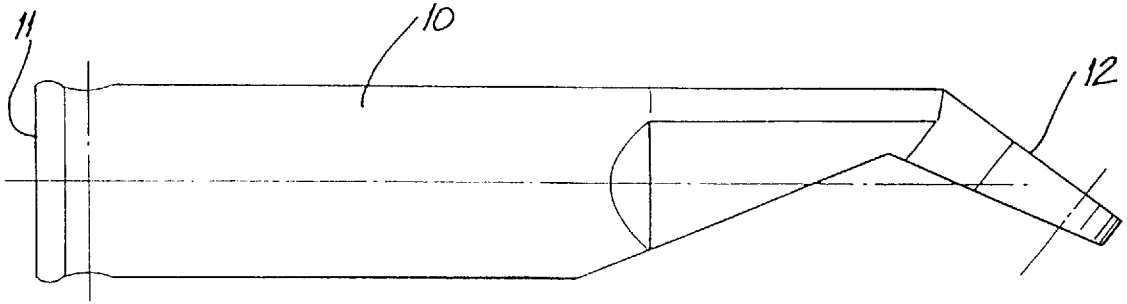
FIG. 7 is a side elevation of the handle of the device of FIG. 1.
Figure 8:
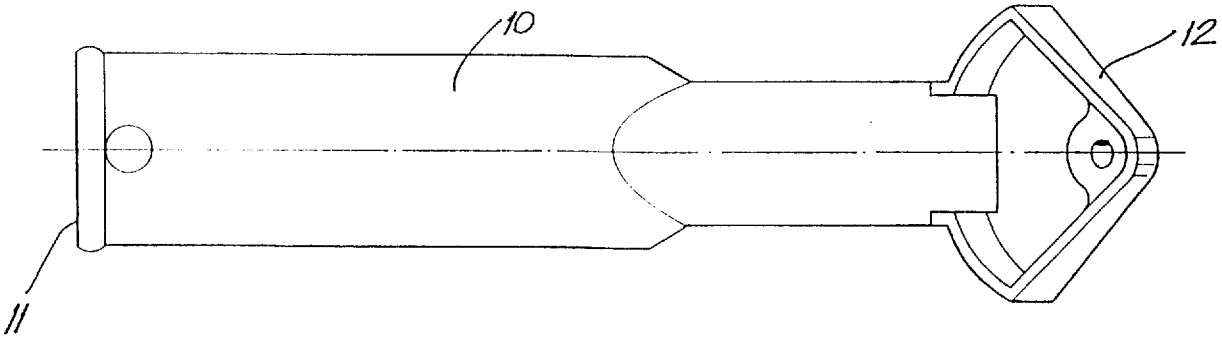
FIG. 8 is an underside view of the handle of FIG. 7.

As depicted in FIG. 2 the blade holder body of head 5 has been reversed by rotating about bolt 13 so that squeegee blade 1 is removed from contact to enable brush or pad 7 to clean the surface without the associated squeegee action. The pad 7 is preferably formed from a piece of carpet or similar material but it may be a brush or piece of sponge or any other suitable material.

It will be appreciated by persons skilled in the art that numerous variations and/or modifications may be made to the invention as shown in the specific embodiments without departing from the spirit or scope of the invention as broadly described. The present embodiments are therefore, to be considered in all respects as illustrative and not restrictive.

I claim:

1. A device for use on a substantially planar surface, the device comprising:

a head holding a squeegee blade and a wiping component, said squeegee blade having an edge, the edge and said wiping component adapted for simultaneously engaging the planar surface; and a handle portion pivotally connected to said head at a substantially central point of the head, said handle portion having a longitudinal axis, wherein said head freely pivots about a single axis, the single axis forming an acute angle with the longitudinal axis of the handle portion, the single axle being perpendicular to the edge of said squeegee blade.

2. A device as claimed in claim 1, wherein the angle between the single axis and the longitudinal axis is about 52 degrees.

3. A device as claimed in claim 1, wherein the wiping component is a brush.

4. A device as claimed in claim 1, wherein the squeegee blade is rotatable about the single axis.

5. A device as claimed in claim 1, wherein said head includes a body having a quadrilateral shape in plan view, having two of its sides parallel and the other two sides oppositely inclined relative to each other.

6. A device as claimed in claim 1, wherein the handle portion is adapted to receive a handle extension attachable to the handle portion in a torque transmitting arrangement.

7. A device as claimed in claim 1, which functions in use so that when the handle portion is maintained at a substantially constant angle relative to the planar surface, any change in orientation of the edge of the squeegee blade depends on movement of the handle portion.

8. A device as claimed in claim 1, wherein the squeegee blade is rotatable about the single axis relative to the planar surface, such that the wiping component is operable without the squeegee blade contacting the planar surface.

9. A device as claimed in claim 2, wherein said head includes a body having a quadrilateral shape in plan view, having two of its sides parallel and the other two sides oppositely inclined relative to each other.

10. A device as claimed in claim 1, wherein the squeegee blade is retractable relative to the planar surface such that the wiping component is operable without the squeegee blade contacting the planar surface.

11. A device as claimed in claim 2, wherein the wiping component is a pad.

12. A device as claimed in claim 1, wherein the wiping component is a pad.

13. A device as claimed in claim 2, wherein the squeegee blade is rotatable about the single axis relative to the planar surface, such that the wiping component is operable without the squeegee blade contacting the planar surface.

14. A device as claimed in claim 2, wherein the squeegee blade is retractable relative to the planar surface such that the wiping component is operable without the squeegee blade contacting the planar surface.

15. A device as claimed in claim 2, wherein the wiping component is a brush.

16. A device as claimed in claim 2, wherein the handle portion is adapted to receive a handle extension attachable to the handle portion in a torque transmitting arrangement.

17. A device as claimed in claim 2, which functions in use so that when the handle portion is maintained at a substantially constant angle relative to the planar surface, any change in orientation of the edge of the squeegee blade depends on movement of the handle portion.

18. A device for use on a substantially planar surface, the device comprising:

a head including a wiping component having a substantially planar engagement surface for engaging the planar surface;

a squeegee blade mounted on said head; and a handle portion pivotally connected to the head at a point substantially central of the head, said handle portion having a longitudinal axis, wherein said head freely pivots about a single axis, the single axis forming an acute angle with the longitudinal axis of the handle portion, and wherein in use said squeegee blade and the engagement surface both engage the substantially planar surface with the squeegee blade trailing the engagement surface.

19. The device of claim 18 wherein the angle between the single axis and the longitudinal axis is 52 degrees.

20. The device of claim 18 wherein the squeegee blade is rotatable about the single axis.

21. The device of claim 18 wherein the squeegee blade is retractable relative to the engagement surface.

22. The device of claim 18 wherein the wiping component is a pad.

23. The device of claim 18 wherein the wiping component is a brush.

* * * * *